United States Patent [19]

Eagles et al.

[11] 4,428,619

[45] Jan. 31, 1984

[54] ROTARY CUTTER HEADS FOR MINING MACHINES

[75] Inventors: Brian A. Eagles; Jonathan S. Kelly, both of Burton-on-Trent, England

[73] Assignee: Coal Industry (Patents) Limited, London, England

[21] Appl. No.: 196,742

[22] Filed: Oct. 14, 1980

[30] Foreign Application Priority Data

Nov. 16, 1979 [GB] United Kingdom ..... 7939749

[51] Int. Cl.[3] ..... E21C 35/22

[52] U.S. Cl. ..... 299/81; 299/87

[58] Field of Search ..... 299/81, 12, 87

[56] References Cited

U.S. PATENT DOCUMENTS

| | | | |
|---|---|---|---|
| 3,876,254 | 4/1975 | Parker | 299/81 |
| 3,904,246 | 9/1975 | Gandy | 299/81 |
| 4,084,855 | 4/1978 | Miles | 299/81 |

FOREIGN PATENT DOCUMENTS

| | | | |
|---|---|---|---|
| 1989818 | 5/1968 | Fed. Rep. of Germany | 299/81 |
| 1385456 | 2/1975 | United Kingdom | 299/81 |

*Primary Examiner*—William F. Pate, III

*Attorney, Agent, or Firm*—Stevens, Davis, Miller & Mosher

[57] ABSTRACT

A rotary cutter head having generally helical loading vanes for urging cut rock or mineral towards a mining machine supporting the cutter head is provided with air flow inducing means for inducing an air flow in a direction substantially away from the mining machine.

8 Claims, 3 Drawing Figures

ROTARY CUTTER HEADS FOR MINING MACHINES

This invention relates to rotary cutter heads for mining machines, the cutter heads being drivably mountable on rotary drive shafts of the machine and having cutter tools mounted around their outer peripheries for breaking rock or mineral from working faces.

Frequently, when such a cutter head is used to break rock or mineral there is a tendency for dust produced by the breaking action of the relatively rapidly moving cutter tools on rock or mineral to be drawn into the slip stream left behind the cutter tools and/or behind support components carrying the cutter tools. Typically, such support components are constituted by generally helical loading vanes upstanding from a hub and arranged to urge broken rock or mineral in a direction substantially parallel to the axis of rotation of the head towards a conveyor extending along the working face. Unfortunately, the action of the loading vanes tends to induce the dust drawn into the slip-stream formed behind the generally helical loading vanes to move away from the relatively sheltered zone around the cutter head into the ventilation air current flowing along the working face. Once the dust is released into the ventilation air flow it is difficult to suppress or control the dust and resultant high concentrations therefore can exist.

An object of the present invention is to provide an improved rotary cutter head which tends to overcome or reduce the above mentioned problem.

According to the present invention, a rotary cutter head for a mining machine having a drive component for drivable engagement by the cutter head, comprises a hub adapted to be drivably engageable with the drive component, a number of cutter tool holders mounted around the hub and adapted to carry cutter tools, and air flow inducing means which, in use, when the cutter head is mounted on the mining machine tend to induce an air flow away from the mining machine.

Preferably, the cutter tool holders are supported on a support component, in use, the air flow inducing means being adapted to induce said air flow in the vicinity of the support component.

Preferably, the air flow inducing means is mounted on the support component.

Preferably, the support component comprises at least one generally helical loading vane for urging broken rock or mineral towards the mining machine.

Advantageously, the air flow inducing means is mounted on a rearward facing surface of the loading vane.

Advantageously, the air flow inducing means comprises at least one nozzle for directing fluid to induce said air flow.

Preferably, the nozzle is arranged to direct the fluid in a direction away from the mining machine.

Preferably, the nozzle is arranged to direct at least a portion of the fluid in a direction towards the rearward facing surface of the loading vane.

Conveniently, further air flow inducing means are provided remote from the first mentioned air flow inducing means to induce a further air flow in a direction substantially towards the mining machine.

The present invention also provides a mining machine having a rotary drive component and a rotary cutter head comprising a hub adapted to be drivably engaged with the rotary drive component, a number of cutter tool holders mounted around the hub and adapted to carry cutter tools, and air flow inducing means which, in use, tends to induce an air flow away from the mining machine.

Preferably, the cutter tool holders are supported on a support component, in use, the air flow inducing means being adapted to induce said air flow in the vicinity of the support component.

Preferably, the air flow inducing means is mounted on the support component.

Preferably, the support component comprises at least one generally helical loading vane for urging broken rock or mineral towards the mining machine.

Advantageously, the air flow inducing means is mounted on a rearward facing surface of the loading vane.

Conveniently, further air flow inducing means are provided remote from the first mentioned air flow inducing means to induce a further air flow in a direction substantially towards the mining machine.

Advantageously, deflector means are provided which tend to urge said further air flow in a radially outward direction in the vicinity of a non-rotary portion of the mining machine.

Conveniently, the deflector means comprises a plate extending between the rotating cutter head and an adjacent portion of the mining machine body.

By way of example only, one embodiment of the present invention will be described with reference to the accompanying drawings, in which.

Figure 1:
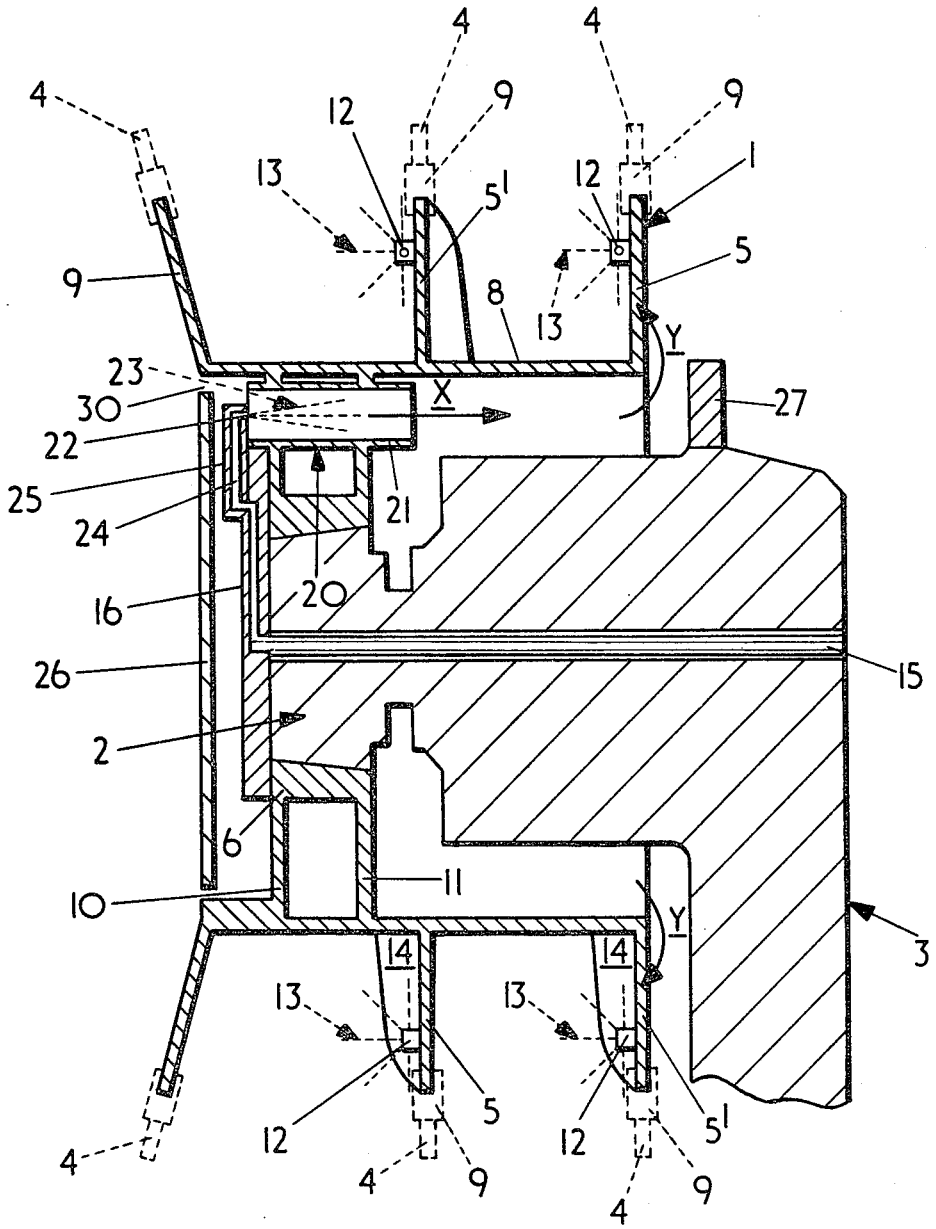
FIG. 1 is a diagrammatic sectional view taken through a portion of a mining machine including a rotary cutter head.

In FIG. 1 a rotary cutter head 1 is shown drivably engaged on a drive shaft assembly 2 of a mining machine 3 (only a portion of a ranging arm gearbox assembly of which is shown). The mining machine is a longwall face coal mining machine of the well known "ranging drum shearer" type comprising a body, a ranging arm pivotable at one end about a substantially horizontal axis under the action of a hydraulic ram and carrying the rotary cutter head or drum at the other end, the cutter head being rotated about a substantially horizontal axis in a direction indicated by arrow R in FIG. 2. In operating such a shearer machine traverses to and fro along a longwall face with cutter tools 4 mounted around the periphery of the cutter head winning coal from the working face. The broken coal is urged towards the machine by means of two generally helical loading vanes 5, 5' and thereby loaded onto an armoured flexible conveyor (not shown) which extends along the longwall face. As the cutter head 1 cuts coal from the working face it forms a buttock in the working face and thereby tends to be shielded from the main ventilation air flow along the face. This is particularly the case if loading means, e.g. a loading coal on loading plate is positioned at the rear of the cutter head.

The cutter head 1 comprises a hub assembly 6 drivably mounted on a tapered component of the drive shaft assembly 2 and retained in position by a key (not shown). A cylindrical barrel component 8 is secured around the hub assembly and forms a mounting platform for the two helical loading vanes 5, 5' which in turn support cutter tool holders 9 for the cutter tools 4.

The barrel component also forms a mounting platform for a part conical plate 9 defining the axial extent of the rotary cutter head in a direction away from the mining machine arms and gearbox. The plate 9 also supports tool holders 9 for cutter tools 4. The barrel component 8 is fixedly secured to the two plates 10 and 11 of the hub assembly.

Figure 2:
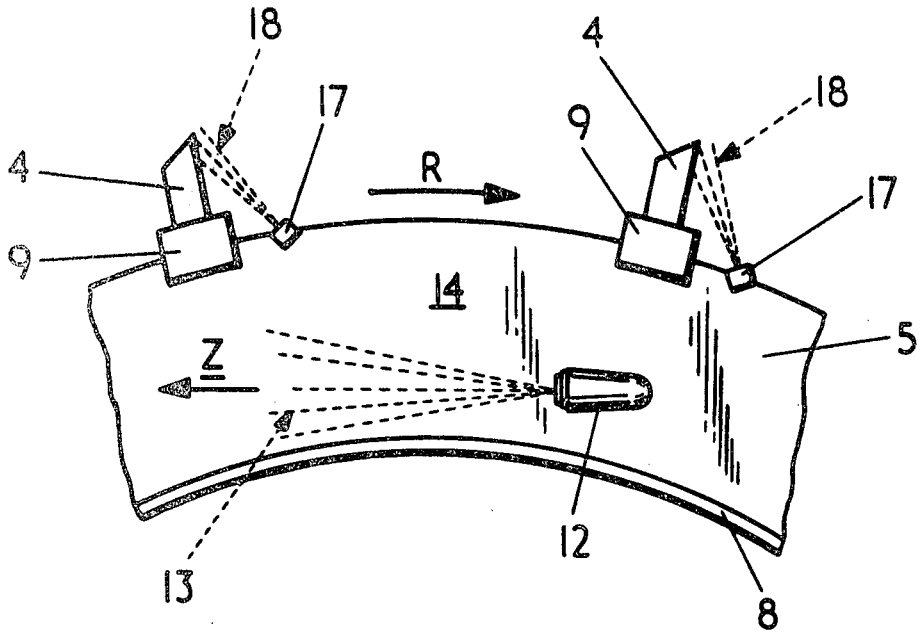
FIG. 2 is an incomplete side view of a detail of FIG. 1.
Figure 3:
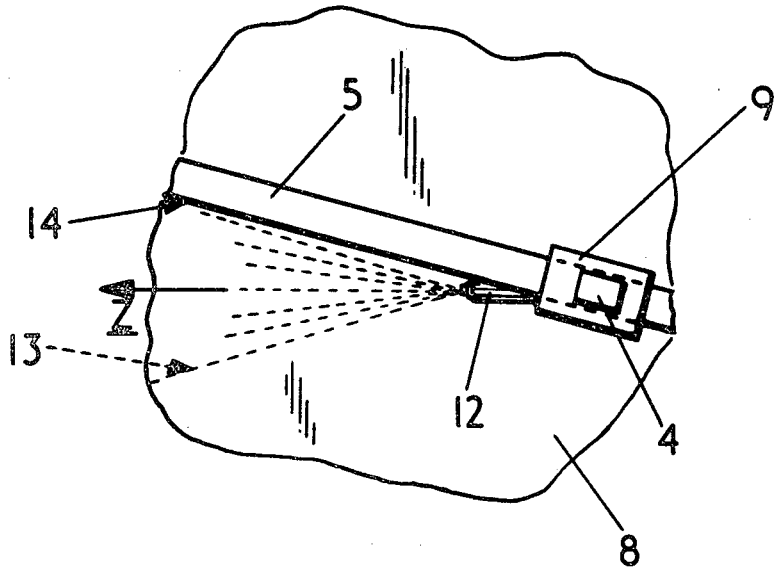
FIG. 3 is an incomplete plan of a portion of the detail of FIG. 2.

The rotary cutter head 1 also comprises air flow inducing means comprising a plurality of nozzles 12 located on the rearward facing surfaces of the loading vanes 5, 5' and arranged to direct fluid spray 13 e.g. water in a direction Z away from the mining machine arm and gearbox. The nozzle mounting also is shown in FIGS. 2 and 3 which illustrate that a portion of the spray is directed towards the rearward facing surface 14 of the associated loading vane 5. In FIGS. 1 and 2 the nozzle is shown mounted part way up the loading vane such that a portion of the spray is directed towards the radially outer surface of the barrel component 8.

Fluid e.g. water is fed to the nozzles 12 from a supply hose (not shown) to a tube 15 extending along the drive shaft assembly 2 which in turn feeds the fluid supply to a distribution block 16 secured to the cutter head hub assembly 6 and sealably engaged with the adjacent end margin of the drive shaft assembly. From the distribution block 16 the fluid supply is fed to the nozzles 12 via passages (not shown) provided in the barrel component 8 and loading vane 5, 5' construction. Alternatively, at least portions of the fluid supply feed passages may be provided by tubes or channels secured to the barrel component and/or the loading vanes.

The fluid supply feed passages also supply fluid to nozzles 17 provided adjacent to the outer periphery of the loading vanes 5 and plate 9 and arranged to direct sprays 18 of dust suppressing fluid towards the cutting portions of the cutter tools 4.

The distribution block 16 also feeds fluid to further air flow inducing means comprising a plurality of devices 20 (only one of which is shown in FIG. 1) arranged to induce an air flow in a direction towards the mining machine gearbox and arm assembly. Each of the devices 20 is mounted in cut-outs provided in the plates 10 and 11 and each comprises an outer tube 21 and a nozzle 22 arranged to direct an air-flow inducing fluid spray 23 along the bore of the tube 21. The nozzle 22 is fed with fluid e.g. water, via a passage 24 defined by a radially extending tubular component 25 sealably secured to the distribution block 16.

A baffle plate 26 is mounted onto the cutter head 1 by brackets (not shown).

A deflector component 27 secured around the machine gearbox assembly 3 is provided to deflect the air flow X induced by the devices 20 in the radially outer direction in the vicinity of the mining machine and thereby back towards the cutter head 1 as indicated by arrows Y.

The induced air flow indicated by arrows Y tends to be drawn further into the cutter head and thereby away from the mining machine gearbox and arm assembly by the previously mentioned nozzles 12 provided on the loading vanes, this air flow together with additional dust laden air tending to be drawn into the slipstream of the loading vanes 5 and 5' as previously explained is induced to flow in the direction away from the mining machine gearbox and arm assembly 3 towards the plate 9 and hence via annular opening 30 defined around the baffle plate 26 to be drawn into the air flow inducing means 20.

Thus, in operation as the cutter head 1 wins coal from the working face as the machine traverses along the longwall face dust laden air tends to be recirculated around the rotating cutter head and tends not to be discharged into the main ventilation air flow existing along the longwall face.

The recirculation of the air flow together with the impaction of the air flow inducing sprays from all the nozzles 12 and 22 with the adjacent surfaces tends to wet the dust particles carried by the air flow which thereby tend to settle into the loading streams of coal urged by the loading vanes towards the conveyor. Hence, dust particles tend to be suppressed from entering the main ventilation air flow and improved dust control is achieved.

In other embodiments of the invention, the air flow inducing means 20 are dispensed with.

From the above description it will be seen that the present invention provides a rotary cutter head from a mining machine which tends to enable greater dust control to be achieved. The invention also provides a mining machine comprising a cutter head enabling greater dust control to be achieved.

We claim:

1. A rotary cutter head for a mining machine having a drive component for drivable engagement by the cutter head, comprising a hub assembly adapted to be drivably engageable with the drive component, a cylindrical barrel component secured around the hub assembly and defining a radially outer surface, at least one cut material loading vane mounted on said radially outer surface defined by the barrel component, a plurality of cutter tool holders mounted around the loading vane, and air flowing inducing means, which in use, when the cutter head is mounted on the mining machine tend to induce an air flow outside the barrel component and in a general direction away from the mining machine, the air flow inducing means comprising a number of air flow inducing sprays, each spray being arranged such that, in use, a portion of the spray is directed towards said radially outer surface of the barrel component and further air flow inducing means mounted within the barrel component and tending to induce a second air flow within the barrel component and in a general direction toward the mining machine, deflection means in said second air flow path for directing said second air flow radially outwardly so as to induce an air flow around the cutter head.

2. A rotary cutter head as claimed in claim 1, in which a number of the air flow inducing sprays are mounted on the surface of the loading vane facing away from the machine.

3. A head as claimed in claim 2, in which the sprays are arranged to direct fluid in a direction away from the mining machine.

4. The cutter head of claim 1, in which the deflection means is a deflector component secured around the machine gearbox and is directed generally radially outwardly thereof.

5. A mining machine having a rotary drive component and a rotary cutter head comprising a hub assembly adapted to be drivably engageable with the drive component, a cylindrical barrel component secured around the hub assembly and defining a radially outer surface, at least one cut material loading vane mounted on said radially outer surface defined by the barrel component, a plurality of cutter tool holders mounted around the loading vane, and air flow inducing means, which in use tend to induce an air flow outside the barrel component and in a direction away from the mining machine, the air flow inducing means comprising a number of air flow inducing sprays, each spray being arranged such that, in use, a portion of the spray is directed towards said radially outer surface of the barrel component and further air flow inducing means mounted within the barrel component and tending to induce a second air flow within the barrel component and in a general direction toward the mining machine, deflection means in said second air flow path for directing said second air flow radially outwardly so as to induce an air flow around the cutter head.

6. A mining machine as claimed in claim 5, in which a number of the air flow inducing sprays are mounted on the surface of the loading vane facing away from the machine.

7. A mining machine as claimed in claim 1, in which the sprays are arranged to direct fluid in a direction away from the mining machine.

8. The mining machine of claim 5, in which the deflection means is a deflector component secured around the machine gearbox and is directed generally radially outwardly thereof.

* * * * *